US012044115B2

(12) United States Patent
Al Majid et al.

(10) Patent No.: US 12,044,115 B2
(45) Date of Patent: Jul. 23, 2024

(54) ELECTRIC SUBMERSIBLE PUMPING SYSTEM BLANKING PLUG WITH FLAPPER VALVE MECHANISM

(71) Applicant: SAUDI ARABIAN OIL COMPANY, Dhahran (SA)

(72) Inventors: Hussain Al Majid, Saihat (SA); Jawad M. Al Khalifah, Sayhat (SA); Alaa S. Shawly, Jeddah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/707,271

(22) Filed: Mar. 29, 2022

(65) Prior Publication Data

US 2023/0313662 A1 Oct. 5, 2023

(51) Int. Cl.

| | |
|---|---|
| ***E21B 43/38*** | (2006.01) |
| ***E21B 33/129*** | (2006.01) |
| ***E21B 34/14*** | (2006.01) |
| ***E21B 43/12*** | (2006.01) |

(52) U.S. Cl.

CPC ..... *E21B 43/38* (2013.01); *E21B 33/1294* (2013.01); *E21B 34/14* (2013.01); *E21B 43/128* (2013.01); *E21B 2200/05* (2020.05)

(58) Field of Classification Search

CPC ..... E21B 37/00; E21B 37/08; E21B 43/121; E21B 43/13; E21B 43/128

See application file for complete search history.

(56) References Cited

U.S. PATENT DOCUMENTS

| | | | | |
|---|---|---|---|---|
| 2,857,970 | A * | 10/1958 | Hopkins | E21B 31/06 166/66.5 |
| 3,420,304 | A * | 1/1969 | Kilgore | E21B 33/1293 285/376 |
| 4,637,468 | A | 1/1987 | Derrick | |
| 4,869,321 | A * | 9/1989 | Hamilton | E21B 29/10 166/309 |
| 4,898,244 | A | 2/1990 | Schneider et al. | |
| 6,216,788 | B1 | 4/2001 | Wilson | |
| 6,814,144 | B2 | 11/2004 | Jones | |
| 7,111,677 | B2 | 9/2006 | St. Clair | |
| 7,431,093 | B2 | 10/2008 | Bearden et al. | |
| 8,316,938 | B2 | 11/2012 | Al-Jarri et al. | |
| 9,097,093 | B1 | 8/2015 | Frost | |
| 10,584,571 | B2 | 3/2020 | Leitch | |
| 11,149,524 | B2 | 10/2021 | Reed et al. | |
| 2004/0206513 | A1 * | 10/2004 | St. Clair | E21B 23/02 166/386 |

(Continued)

OTHER PUBLICATIONS

George E. King Engineering's "5000 Oilfield Terms: A Glossary of Petroleum Engineering Terms, Abbreviations and Acronyms" pp. 22, 26, 166. Defining Bridge Plug, Retrievable Bridge Plug, & Blanking Plug (Year: 2010).*

(Continued)

*Primary Examiner* — David Carroll

(74) *Attorney, Agent, or Firm* — Osha Bergman Watanabe & Burton LLP

(57) ABSTRACT

A blanking plug for isolating the wellbore of a fluid-producing well during operation of an electric submersible pump is provided with a sand trap positioned at the upper end of the plug. The sand trap is in the form of a flapper valve mechanism and includes a particulate accumulation chamber.

17 Claims, 3 Drawing Sheets

(56) References Cited

U.S. PATENT DOCUMENTS

| | | | | |
|---|---|---|---|---|
| 2015/0308232 | A1 | 10/2015 | Hallundbaek | |
| 2016/0060989 | A1* | 3/2016 | Pedersen | E21B 31/08 166/99 |
| 2017/0114636 | A1 | 4/2017 | Krüger et al. | |
| 2019/0029687 | A1* | 1/2019 | Leitch | E21B 43/08 |
| 2019/0368291 | A1* | 12/2019 | Xiao | E21B 43/128 |
| 2022/0235619 | A1 | 7/2022 | Nafa et al. | |

OTHER PUBLICATIONS

American Heritage Dictionary—body—https://www.ahdictionary.com/word/search.html?q=body (Year: 2023).*

American Heritage Dictionary—single—https://www.ahdictionary.com/word/search.html?q=single (Year: 2023).*

Modahi, Mazen H., "The Importance of Electrical Submersible Pumps (ESPs) in Maximizing Oil Recovery"; Submitted in partial fulfilment of the requirements for the degree of Master of Engineering; Major Subject: Petroleum Engineering; Dalhousie University; pp. ii-67; Jul. 2012 (81 pages).

Final Office Action issued in related U.S. Appl. No. 17/707,648, issued Jun. 23, 2023 (12 pages).

Final Office Action issued in related U.S. Appl. No. 17/707,648, issued Sep. 14, 2023 (12 pages).

Non-Final Office Action issued in related U.S. Appl. No. 17/707,648, issued Dec. 21, 2023 (17 pages).

Oxford Learner's Dictionary—Embed https://www.oxfordlearnersdictionaries.com/us/definition/american_english/embed (Year: 2023).

First Examination Report issued in related Saudi Arabian Application No. 123446748, issued Mar. 21, 2024 (11 pages).

* cited by examiner

ELECTRIC SUBMERSIBLE PUMPING SYSTEM BLANKING PLUG WITH FLAPPER VALVE MECHANISM

BACKGROUND

In hydrocarbon well development, it is common practice to use electric submersible pumping systems (ESPs) as a primary form of artificial lift. A challenge with ESP operations is sand and solids precipitation and deposition on top of the ESP string. In order to reduce the need to remove the ESP from the wellbore in order to perform well intervention operations downhole, a Y-tool bypass assembly is employed in which the ESP is positioned in the bypass section in order to allow access to the wellbore section.

During the production phase, a blanking plug is installed in the wellbore at the Y-tool in order to prevent fluid circulation around the ESP and resulting ESP shutdown due to a variety of possible causes. Such a blanking plug must be removed from the wellbore each time a well intervention operation is performed. However, the blanking plug creates different challenges during retrieval due to the associated sand and scale accumulation on top of the plug body. Accumulating solid compositions can include one or more types of sand and scale, such silica ($SiO_2$), calcium carbonate ($CaCO_3$), calcium sulfate ($CaSO_4$), strontium sulfate ($SrSO_4$), dolomite ($CaMg(CO_3)_2$), and corrosion products and the like.

In addition, deposition of solids can result in an increase in ESP trips due to motor high temperature and overload. Motor electrical shorts can occur due to scale and corrosion buildup in the pump forcing the motor to work harder and exceed its designed rating. Moreover, as adequate flow of produced fluid past the motor is required for cooling, solids blockage of a pump's flow path above the ESP and solids build up around the outside of the motor may lead to rapid motor internal heat rise, insulation breakdown and electrical short. Some ESP wells cannot restart after a shutdown due to shaft rotation restriction from solids build up between the shaft and radial bearings, therefore requiring a workover to change out the ESP.

Accordingly, there exists a need for preventing or minimizing sand and scale accumulation on top of the blanking plug used in association with an ESP. There is also a need for eliminating or reducing the need for high cost sand/scale removal operations from the top of the blanking plug, which causes delay and increased non-productive time during well intervention operations. Moreover, there exists a need for preventing or minimizing sand and scale accumulation around the ESP shaft, thereby reducing ESP failures due to sand/scale accumulation, and for overcoming additional pressure drop during oil well production startup.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an improved blanking plug for use in association with an ESP in an oil well. In another aspect, a mesh basket is provided to trap and store accumulating sand and scale on top of a blanking plug. In yet another aspect, a wireline assembly includes a flapper valve mechanism that can be periodically withdrawn from the wellbore to remove and dispose of accumulating sand and scale. In a further aspect, use of a blanking plug having a flapper valve mechanism structure eliminates or reduces problems associated with use of a blanking plug in an oil well provided with an ESP for lifting petroleum fluids to the surface. In another aspect of the disclosure of embodiments, a blanking plug simplifies collection of sand and scale sample for subsequent laboratory analyses which may be used to create or improve scale mitigation plans.

In another aspect of an embodiment, a process or procedure is disclosed for installing an ESP in a hydrocarbon fluid-producing well drilled in a sandstone or other earth formation in which sand and/or other particulates are entrained in the extracted fluids. According to the disclosure, an improved blanking plug is employed to facilitate operation of the ESP while providing periodic access to the wellbore. The plug includes features that reduce and minimize trapping of the plug beneath a column of accumulated particulate matter.

Other aspects and advantages of the claimed subject matter will be apparent from the following description and the appended claims.

BRIEF DESCRIPTION OF DRAWINGS

The following figures are included to illustrate certain aspects of the embodiments, and should not be viewed as exclusive embodiments. The subject matter disclosed is amenable to considerable modifications, alterations, combinations, and equivalents in form and function, as will occur to those skilled in the art and having the benefit of this disclosure.

DETAILED DESCRIPTION

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the level of skill of persons having ordinary skill in the relevant art.

The present disclosure relates to blanking plugs used in conjunction with electrical submersible pumps used in hydrocarbon development operations. More specifically, the disclosure relates to blanking plugs with improved capability to minimize problems in well intervention operations caused by accumulation of sand and other solids on top of blanking plugs.

As will be made clear in the following detailed description of the embodiments of the present disclosure, at least one of the following advantages and benefits may be provided or achieved by one or more of the disclosed embodiments: prevention or minimization of sand and scale accumulation on top of the ESP blanking plug; elimination or reduction of the need for high cost sand/scale fill removal operations; provision of wellbore accessibility for vital well intervention operations; provision of simplified sand/scale sample collection for subsequent lab analysis thus improved scale mitigation planning; protection of ESP integrity and prolonged ESP run life; prevention of sand accumulation around the ESP shaft; reduction of ESP failures due to sand/scale accumulation; minimization of additional pressure drop during oil well startup operations.

An embodiment of the disclosure incorporates a customized wireline assembly above an ESP blanking plug body that can be utilized to allow for sand or scale particles to be trapped inside the chamber thus preventing any solid accumulation on top of the plug.

Figure 1:
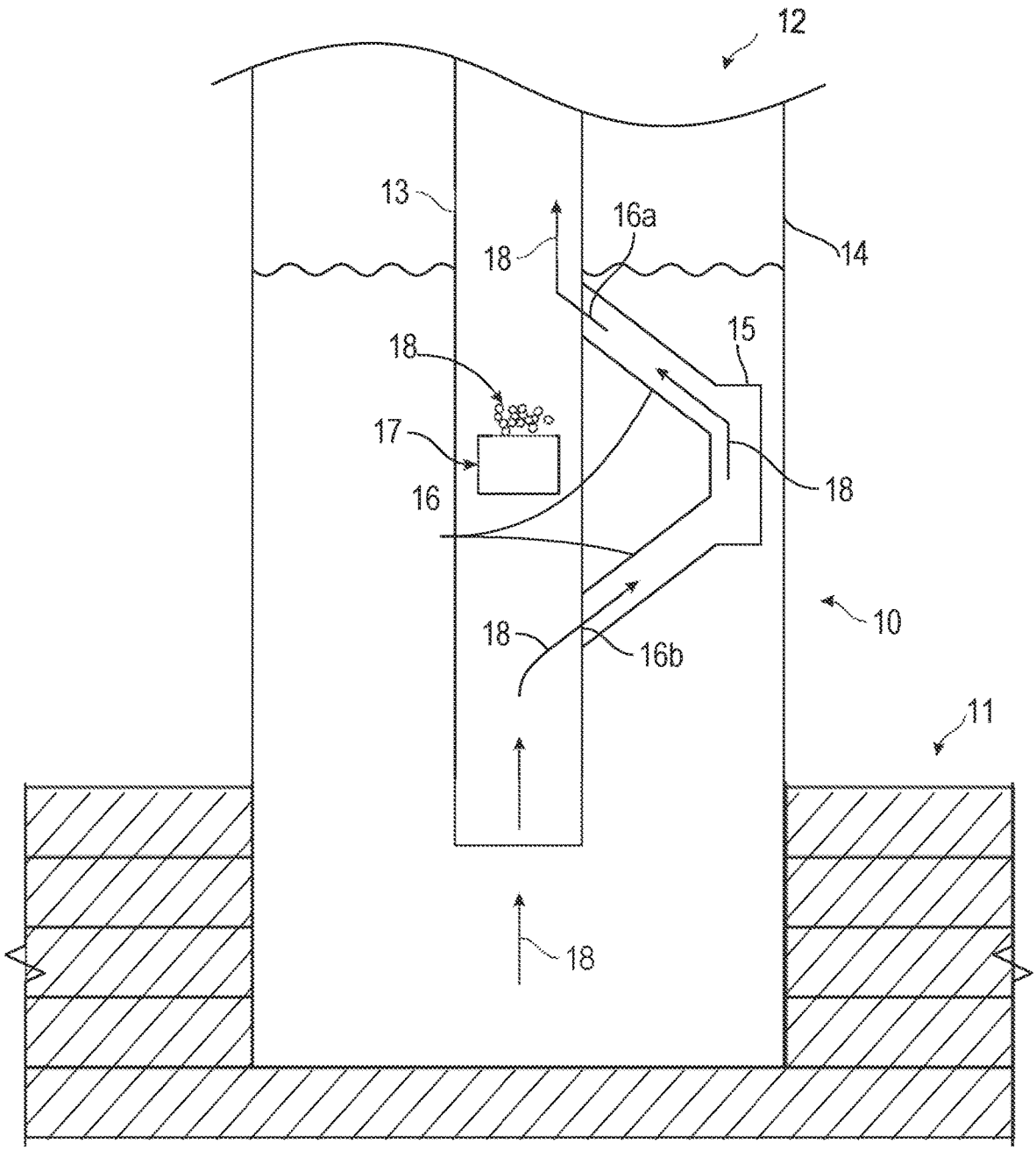
FIG. 1 is a schematic illustration of a liquid petroleum well equipped with an ESP in a Y-tool in fluid communication with a production tubing string, and an associated blanking plug positioned in the tubing string, in accordance with one or more embodiments.

As illustrated schematically in FIG. 1, an oil well 10 generally provides for extraction of petroleum and other wellbore fluids from a formation 11 in the earth and transport of such fluids to the surface 12 of the well 10. The well 10 can an offshore well or a land-based well and can be used for producing hydrocarbons from subterranean hydrocarbon reservoirs.

In construction of the well 10, production tubing string 13 is positioned within the casing 14 of the well 10. In an embodiment of this disclosure, a system for providing artificial lift to wellbore fluids includes a pump 15, which is an electrically submersible pump (ESP), submerged in wellbore fluids and in fluid communication with the tubing string 13 extending within the wellbore. The ESP 15 can be, for example, a rotary pump such as a centrifugal pump. The ESP 15 could alternatively be a progressing cavity pump, which has a helical rotor that rotates within an elastomeric stator or other type of pump known in the art for use in an ESP.

The ESP is oriented to selectively boost a pressure of the wellbore fluids traveling from the formation 11 of the well 10 towards the earth's surface 12, as is well known and conventional in the art, so that wellbore fluids can travel more efficiently to the earth's surface 12.

During production operations, access to the formation 11 from the surface 12 is occasionally required. In order to avoid the necessity of withdrawing the ESP from the tubing 13 each time such access is necessary, the ESP is positioned in a Y-tool 16 adjacent to, outside of, and in fluid communication with the tubing string 13, as is known in the relevant art. In order to prevent recirculation of fluids lifted by the ESP 15 back down the tubing 13, a blanking plug 17 is positioned in the tubing 13 adjacent and between the upper and lower passages or connections 16*a*,16*b*, respectively, of the Y-tool 16 to the tubing string 13. While tubing string 13 is schematically illustrated as being vertical in FIG. 1, it will be understood by persons having ordinary skill in the art that the tubing string 13 may have an orientation other than vertical; thus, the terms "upper" and "lower" in the description of this embodiment are intended to signify relative positions rather than physical directions. More particularly, the "upper" Y-tool connection 16*a* to the tubing 13 is simply the connection closer to the surface 12 of the well 10, and the "lower" Y-tool connection 16*b* is closer to the distal end of the tubing string 13 located in the formation 11.

Further during production operations, the ESP lifts fluids in a flow direction 18 and path from the formation 11 through the tubing 13, into the Y-tool 16 via the lower connection 16*b*, through the ESP 15, out the Y-tool 16 via the upper connection 16*a* back into the tubing string 13 and to the surface 12 of the well 10. In addition to desirable fluids, however, sand which may be silica ($SiO_2$), calcium carbonate ($CaCO_3$), calcium sulfate ($CaSO_4$), strontium sulfate ($SrSO_4$), dolomite ($CaMg(CO_3)_2$), and other corrosion products are also entrained in the fluids and are also lifted by and through the ESP 15. Upon reentry of the fluids via the upper Y-tool connection 16*a* into the tubing 13 above or past the blanking plug 17, such sand 18 and other particulates tend to settle on top of the blanking plug 17.

If not addressed in some way, such as by embodiments of the present disclosure, sand 18 may accumulate to such a degree and amount that retrieval of the blanking plug 17 is very difficult or, in extreme cases, nearly impossible. In addition, accumulation of sand 18 on top of the blanking plug 17 may cause sand and scale to also accumulate within the ESP 15 and, more particularly, around the shaft of the pumping mechanism within the ESP 15, which may reduce ESP run life and integrity and, consequently, lead to premature pump failures.

Figure 2:
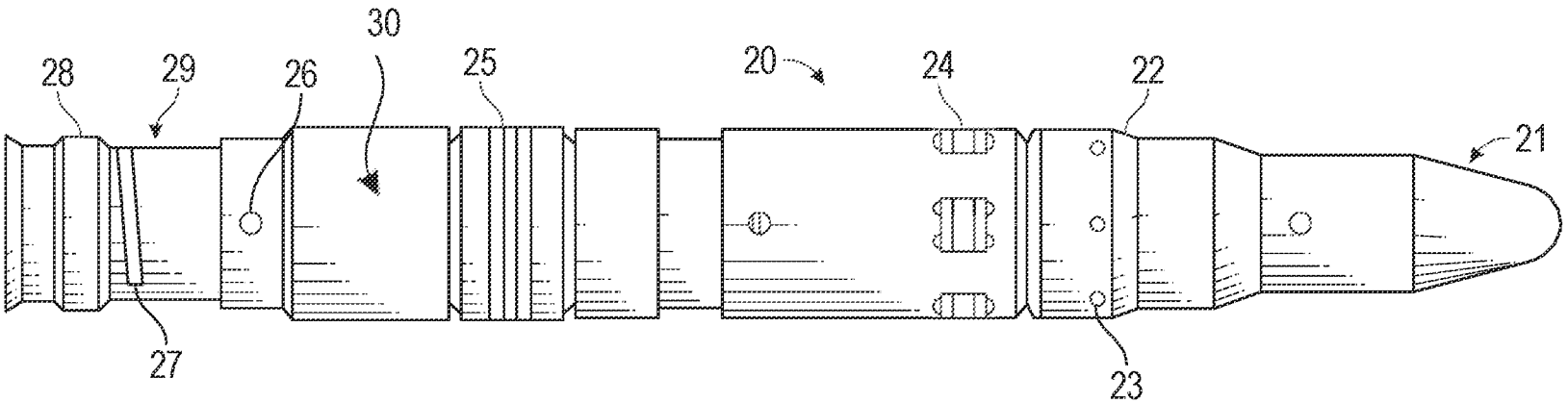
FIG. 2 is a perspective view of an embodiment of a blanking plug of the disclosure.

Referring now to FIG. 2, an embodiment of an improved blanking plug 20 for use in association with an ESP 15 as shown in the well environment illustrated in FIG. 1. At the downhole end of the plug 20 is a flow isolation mechanism 21. Flow isolation mechanism 21 prevents downhole recirculation of lifted fluids across the Y-tool 16. A positioning structure such as a no-go shoulder 22 is provided to fit closely and stop downhole movement of the blanking plug 20 at a complimentary nipple or profile of the inside wall of the tubing string 13. A series of circumferentially positioned shear pins 23 is provided, the function of which will become clear in connection with further features now described.

At least one locking device is provided to hold the blanking plug 20 at a desired first working position in the tubing 13. In an embodiment, the locking device, which may also serve as a positioning structure, comprises a set of radially extending locking dogs 24 which, when extended, hold the blanking plug 20 at a desired position. The locking dogs 24 are activated and radially extended by operation of the shear pins 23 in conventional fashion. The embodiments of the present disclosure are not limited to the disclosed anchoring or positioning components or assemblies. Instead, other types of anchoring mechanisms, including those that, for example, do not require a complimentary profile or nipple within the tubing string and those that might anchor within a tubing string using slips, packers, or other means known in the art for securing a tool within a conduit, may be employed.

Circumferential elastomeric seals 25, such as elastomeric O-rings, provide additional fluid sealing between the surface and downhole ends of the plug 20, and consequently between the upper and lower Y-tool connections 16*a*,16*b*. A pressure equalization port 26 located proximate the upper end of the blanking plug 20 is connected to an internal pressure equalization passage 30 extending within the blanking plug 20 from the port 26 to an opening in the flow isolation mechanism 21. When opened by activation of the shear pins 23, the port provides pressure equalization below and above the plug 20.

Specifically, the blanking plug device has an anchoring portion for securing the blanking plug device within a tubing string or other well conduit. The blanking plug device may be used for blanking off all pressure from above or below the device in connection with pressure testing the tubing string or to abandon certain zones within a well. The blanking plug may include a no-go shoulder, radially expandable locking dogs, pressure equalization ports, and annular seals, among other conventional features of blanking plugs. Further or more specific detail of these features is not necessary for a complete disclosure and understanding of the embodiments of the present disclosure, as component parts of the blanking plug thus far described are conventional and known to those of ordinary skill in the art.

Referring again to FIG. 2 of the present disclosure, a sand trap 29 with flapper valve mechanism 27 is provided at the upper end of the blanking plug 20. As sand and other particulates are lifted by the ESP 15 and flow upward to the surface 12 of the well 10, the sand and particulates will settle into a particulate accumulation chamber in the trap 29 for subsequent collection, disposal, and optionally laboratory testing. A standard internal fishing neck 28 designed to be latched by a conventional GS style pulling tool is provided above the sand trap 29. While a GS style fishing neck is illustrated, any other wireline or slickline pulling tool and corresponding on-device connector structure may be employed.

Figure 3:
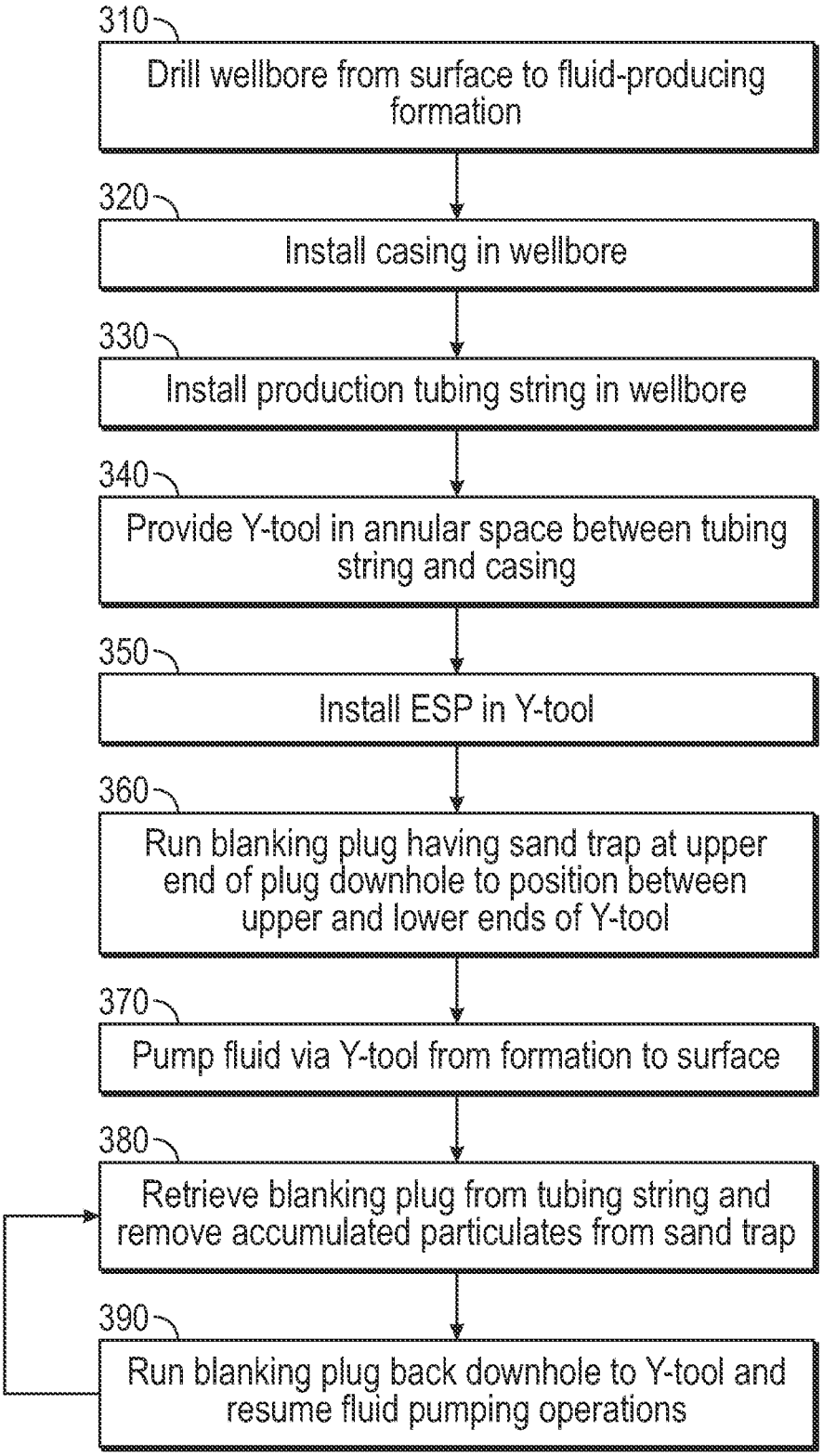
FIG. 3 shows a flowchart in accordance with one or more embodiments disclosed herein.

During production operations, after a certain time has passed, a well operator will briefly pause production operations for the purpose of removing the accumulated sand 18 and other particulates within the sand trap 29 on top of the blanking plug 20. Referring to FIG. 3, an embodiment of a method of using a blanking plug of the present disclosure is illustrated in flowchart format. While the method steps are illustrated in a particular order, it will be understood that some of the steps may be performed in different sequences than as is illustrated.

According to the embodiment of FIG. 3, a method of producing fluids from a fluid-producing formation 11 in the earth is shown. A wellbore is drilled from a surface 12 of the earth to a fluid-producing formation 11 in the earth (STEP 310) in any conventional manner. Likewise, in any conventional manner wellbore casing 14 is installed (STEP 320) followed by installation of a production tubing string 13 (STEP 330) extending into the fluid-producing zone 11 of the formation. An annular space is provided between the tubing string 13 and the wellbore casing 14 in known fashion.

A Y-tool 16 having upper and lower connections 16*a*,16*b* to the tubing string 13 is provided in the annular space (STEP 340) and a pump 15, which may be an ESP, is installed in the Y-tool 16 (STEP 350). These steps may be performed in any desired and convenient order, for example, by first providing a subassembly comprising a section of production tubing having an ESP-fitted Y-tool connected thereto, and then incorporating such subassembly into the tubing string during installation of the tubing string.

A blanking plug 20 having a sand trap 29 at its upper end according to an embodiment of the present disclosure is next run downhole via wireline or any other suitable manner, to a working position located between the upper and lower connections 16*a*,16*b* of the Y-tool 16 (STEP 360). Fluids are then pumped by the ESP 15 via the Y-tool 16 from the fluid-producing formation 11 to the surface 12 of the well 10 (STEP 370).

After a period of pumping fluids, pumping operation of the ESP 15 is suspended. A GS style or any other appropriate pulling tool is run downhole to mate with and attach to the fishing neck 28 of the blanking plug 20. The locking dogs 24 are moved radially inwardly thereby unlocking the blanking plug 20 from its working position. The blanking plug 20 is then withdrawn from the tubing string 13, and the sand trap 29 is emptied of accumulated particulates (STEP 380). Next, the blanking plug 20 in returned to its downhole position adjacent the Y-tool 16 and pumping operations are resumed (STEP 390). After another period of pumping, the blanking plug 20 is again retrieved for emptying of the sand trap 29 (STEP 380).

During retrieval of the blanking plug 20 from the tubing string 13, the flapper valve mechanism 27 positioned in the wall of the particulate accumulation chamber of the sand trap 29 allows sand/scale to be trapped inside the sand trap 29 while trapping additional sand and scale present or suspended in the fluid column extending from the Y-tool 16 to the surface 12 of the well 10.

The appropriate size of openings of the flapper valve mechanism 27 will depend on the nature of the sand, scale, and other particulate matter in a given fluid produced by a particular well. In addition, the size of the sand trap will depend on the accumulation rate of settling solid particles, which may in turn depend on the flow rate and volume, as well as viscosity, of the fluid being lifted by the ESP. Using this information, accurate estimation of the appropriate time interval between successive retrievals of the blanking plug for disposal of the collected sand and scale is easily done, with a goal of avoiding over-filling of the sand trap. As is conventional in the art, the appropriate size of wireline cable that can withstand the combined weight of the blanking plug including the flapper valve mechanism and accumulated sand is selected.

Although only a few exemplary embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A blanking plug having an upper end and a downhole end comprising:

a flow isolation mechanism at the downhole end of the blanking plug;

at least one positioning structure for positioning the blanking plug in a tubing string of a well;

at least one locking device for holding the blanking plug at a first working position in the tubing string; and a sand trap positioned at the upper end of the blanking plug, the sand trap comprising a particulate accumulation chamber and a flapper valve mechanism in a wall of the chamber, wherein the blanking plug and the sand trap are configured to be run-in and retrieved from the well without being separated.

2. The blanking plug of claim 1, further comprising:

a fishing neck positioned on the sand trap.

3. The blanking plug of claim 1, further comprising:

a pressure equalization passage extending within the blanking plug from a pressure equalization port located proximate the upper end of the blanking plug to the flow isolation mechanism.

4. The blanking plug according to claim 1, wherein the positioning structure comprises at least one of a no-go shoulder and a plurality of radially extendable locking dogs.

5. The blanking plug of claim 1, further comprising:
a fishing neck positioned on the sand trap;
a pressure equalization passage extending within the blanking plug from a pressure equalization port located proximate the upper end of the blanking plug to the flow isolation mechanism; and
wherein the positioning structure comprises at least one of a no-go shoulder and a plurality of radially extendable locking dogs.

6. The blanking plug according to claim 1,
wherein the blanking plug and the sand trap are configured to be run-in again, after retrieval from the well, without being separated.

7. A system for producing fluids from a fluid-producing formation in the earth comprising:
a wellbore extending from a surface to the fluid-producing formation;
a tubing string positioned in the wellbore;
a Y-tool having upper and lower connections in fluid communication with the tubing string;
a pump connected to the Y-tool for pumping fluid from the lower connection to the upper connection of the Y-tool; and
a blanking plug having an upper end and a downhole end positioned in the tubing string between the upper and lower connections of the Y-tool, the blanking plug comprising a sand trap positioned at the upper end, the sand trap comprising a particulate accumulation chamber and a flapper valve mechanism in a wall of the chamber,
wherein the blanking plug and the sand trap are configured to be run-in and retrieved from the well without being separated.

8. The system of claim 7, wherein the pump is an electric submersible pump (ESP).

9. The system of claim 8, wherein the blanking plug further comprises:
a flow isolation mechanism at the downhole end of the blanking plug;
at least one positioning structure for positioning the blanking plug at a first working position in the tubing string between the upper and lower connections of the Y-tool;
at least one locking device for holding the blanking plug at the first working position in the tubing string; and
a fishing neck positioned on the sand trap.

10. The system according to claim 7,
wherein the blanking plug and the sand trap are configured to be run-in again, after retrieval from the well, without being separated.

11. A method of producing fluids from a fluid-producing formation in the earth, comprising the steps:
drilling a wellbore from a surface to the fluid-producing formation;
installing a casing in the wellbore;
installing a production tubing string in the wellbore, providing an annular space between the casing and the tubing string;
providing a Y-tool in the annular space and having upper and lower connections in fluid communication with the tubing string;
installing a pump in the Y-tool for pumping fluid from the lower connection to the upper connection of the Y-tool;
providing a blanking plug having an upper end and a downhole end, the blanking plug comprising a sand trap positioned at the upper end, the sand trap comprising a particulate accumulation chamber and a flapper valve mechanism in a wall of the chamber,
running the blanking plug and the sand trap down the tubing string to a first working position between the upper and lower connections of the Y-tool;
pumping fluid containing particulates from the formation to the surface via the Y-tool;
after a period of accumulation of particulates in the sand trap, retrieving and withdrawing the blanking plug from the tubing string;
disposing of the accumulated particulates contained in the sand trap without separating the blanking plug and the sand trap;
again running the blanking plug and the sand trap down the tubing string to the first working position; and
resuming pumping fluid containing particulates from the formation to the surface via the Y-tool.

12. The method of producing fluids according to claim 11, wherein the pump is an electric submersible pump (ESP).

13. The method of producing fluids according to claim 11, wherein the blanking plug further comprises:
a flow isolation mechanism at the downhole end of the blanking plug.

14. The method of producing fluids according to claim 11, wherein the blanking plug further comprises:
at least one positioning structure for positioning the blanking plug in the tubing string.

15. The method of producing fluids according to claim 11, wherein the blanking plug further comprises:
at least one locking device for holding the blanking plug at a first working position in the tubing string.

16. The method of producing fluids according to claim 11, wherein the blanking plug further comprises:
a fishing neck positioned on the sand trap.

17. The method of producing fluids according to claim 11,
wherein the pump is an electric submersible pump (ESP), and
wherein the blanking plug further comprises:
a flow isolation mechanism at the downhole end of the blanking plug;
at least one positioning structure for positioning the blanking plug in the tubing string;
at least one locking device for holding the blanking plug at a first working position in the tubing string; and
a fishing neck positioned on the sand trap.

* * * * *